US005987946A

United States Patent [19]

Watts

[11] Patent Number: 5,987,946

[45] Date of Patent: Nov. 23, 1999

[54] LOCK PICKING METHOD AND APPARATUS

[76] Inventor: James A. Watts, 2450 W. 82 St., Unit 201, Hialeah, Fla. 33016

[21] Appl. No.: 08/911,647

[22] Filed: Aug. 15, 1997

[51] Int. Cl.[6] ..... E05B 19/20

[52] U.S. Cl. ..... 70/394; 29/426.1; 29/426.4; 70/379 R; 70/380; 70/417; 70/465; 408/1 R

[58] Field of Search ..... 70/1.5, 380, 1.7, 70/394, 417, 428, 465, 379 R, 379 A; 29/426.1, 426.4, 426.5; 33/539, 540; 408/1 R

[56] References Cited

U.S. PATENT DOCUMENTS

| | | | |
|---|---|---|---|
| 2,036,764 | 4/1936 | Lowe | 70/379 R |
| 3,276,233 | 10/1966 | Russell et al. | 70/428 |
| 3,319,443 | 5/1967 | Perlick | 70/417 |
| 3,827,151 | 8/1974 | Naill | 70/394 X |
| 3,985,010 | 10/1976 | Idoni | 70/394 X |
| 4,068,510 | 1/1978 | Neary | 70/379 R |
| 4,338,806 | 7/1982 | Cox | 70/417 |
| 4,535,546 | 8/1985 | Smith | 70/394 X |
| 4,667,494 | 5/1987 | Joosten | 70/394 |
| 5,172,578 | 12/1992 | Bitzios | 70/394 |

FOREIGN PATENT DOCUMENTS

| | | | |
|---|---|---|---|
| 2415184 | 9/1979 | France | 70/417 |
| 320773 | 5/1920 | Germany | 70/394 |
| 386620 | 4/1931 | United Kingdom | 70/379 R |
| 872276 | 7/1961 | United Kingdom | 70/379 R |

*Primary Examiner*—Lloyd A. Gall

*Attorney, Agent, or Firm*—Robert M. Schwartz; Gerald Hibnick

[57] ABSTRACT

Method and apparatus for non-destructively picking locks which normally are operated by keys, such locks capable of having twisting tumbler pins and sidebars. The method requires that: the pins be raised high in the keyway; the plug be axially bored by a thin drill which enters through a low portion of the keyway, the rear end of the drilled bore opening to the bolt cam operator; the drill bit be removed from the bore; and then the bolt cam operator be directly turned to shift open the bolt. This method does not decode the tumblers nor release any sidebar. The preferred apparatus comprises a pin raiser tool, which is self-retaining due to bias on the pins, which is transmitted to the handle of this tool; and a torquing tool, which is passed through the bore and has a blade which seats in the cam operator for turning the operator to shift open the lock bolt. A unique safety shield can be installed on the tailpiece to prevent picking by the method of this invention.

22 Claims, 2 Drawing Sheets

LOCK PICKING METHOD AND APPARATUS

BACKGROUND OF THE INVENTION

1. Field of the Invention

This invention relates to method and apparatus for picking locks, particularly locks of the pin tumbler type having pins which are displaced by insertion of a key, whereupon the key can be rotated sufficiently to intersect with lock structure to draw back or release the lock bolt.

2. The Prior Art

The picking, i.e. opening of locks, is a specialty of locksmiths in the non-destructive opening of a lock, without use of the key specific for that lock. As locks become more complex to thwart illegal and unwanted picking, it becomes more difficult for locksmiths to accomplish legal lock picking. Not only does lock picking require skill and experience, various different tools have been designed to be used on different types of key operating on pin tumbler type locks. If a lock is too difficult to pick, then the time-cost of picking might result in a decision to use destructive entry by: destroying the lock in the belief that it then can be opened; drilling/sawing the entire lock from the surface/door into which it is mounted; or breaking and entering into the locked area to locate another key for that lock, or to dismantle the lock from the interior side of the locked area. In each situation the total cost of the legal entry into the locked area can be significant, because the lock was made so well as to thwart picking.

Lock picking tools and methods, even those limited to locks having pins that are acted upon by the insertion of a key, are so numerous as to cause their description herein to be inappropriate. Historically, lock picking has attempted to simulate the action of the key as it slides along the keyway and encounters the biased pins sequentially. Thus, this form of picking displaces/aligns the tumblers, the pins or wafers, depending upon the mechanism of the lock. Some locks are built so that, once the pins are aligned in a certain manner, the plug in which they are housed can be removed from the cylinder within the lock; thereupon, the locksmith can encode that subassembly of pins to a key he supplies easily for opening the lock, since the newly encoded plug is reinserted in the lock cylinder. Some locks include a side bar, in addition to the pins, tumblers or wafers which the key displaces/aligns. Such side bar must be moved out of latching position, separate from the displacing of the pins, requiring additional lock picking tools and skills. More sophisticated locks have twisting tumblers, which require both axial displacement and rotation around their longitudinal axis to achieve correct displacement by the key or by picking tools.

There is a method of drilling into a side bar with wafer type of automobile lock, in which a tool is passed through the drilled passageway to retract the side bar, while another tool is used to align the wafers; whereupon, the lock assembly is removed for conventional re-keying. Even where drilling into a lock might be a possible step in picking, the drill often binds and then breaks inside the lock, thus forcing lock removal by another non-picking, destructive approach and then replacement of the lock. Even if lock drilling is not thwarted by security means and the drilling step is successful itself, there has been created a new problem—the removal of the drill caused burrs and bits of metal from the interior of the lock—so that the pins, springs, tumblers, side bar, etc. remain free to be displaced, rotated, moved, not restricted by impinging metallic burrs and bits due to the drilling. A well known, destructive method of forced entry employs drilling through the lock, along the shear line which is at the juncture of the shell and plug. If such drilling is not inhibited by lock security features, the plug then is freed to turn, but the lock must be replaced.

More sophisticated, high security locks use combinations of pick thwarting mechanisms, some of which have just been mentioned, and further employ structural inhibitors to defeat invasive, semi-destructive or significantly destructive tools and methods of lock opening and picking. Some of these structural inhibitors include: hardened steel, anti-drill inserts, especially in the plug; anti-pry pin covers; high strength steel components, including shields; anti-saw dead bolts, etc. As a consequence, the very well built high security locks are not pickable, at least not in an economic manner. This has lead to the destructive removal of these types of lock, when the key is not available. Such lock destruction and replacement with a new high security lock, even from the same manufacturers is costly and time consuming to obtain entry into the locked area and securing that area with the new lock. If entry was to be by an unauthorized person, when speed, not cost, is important, sawing around the entire high security lock assembly might be more practical than using locksmith tools and techniques; but that probably would trigger a burglar alarm system, as would breaking a window or door/wall panel of the secured area.

Because of their cost, high security locks are manufactured by only a few companies and are of a few basic types per company, at least when considering the variables with respect to lock picking tools and methods. Nevertheless, many state-of-the-art high security locks cannot be non-destructively picked by experienced locksmiths employing currently available tools and procedures. Moreover, certain of the more complex locks can be picked only by use of a plurality of tools, requiring simultaneous use of some of them; whereby, both hands of the locksmith are needed and at times a third hand would be beneficial.

SUMMARY OF THE INVENTION

The present invention is capable of use in picking numerous type of key operated, pin tumbler containing locks, especially including high security locks, with a time efficient and low cost method, using two simple tools sequentially and a non-destructive drilling of the lock plug. First, a pin raising tool, having a thin lifting wire, is passed axially through the open top of the keyway, to lift the pins above the top plane of the keyway. The exterior handle portion of this tool is shaped to butt against the exterior face of the lock and the adjacent door/wall housing the lock; whereby, when the pin lifting wire is biased by the tumbler springs, the pin raiser tool is held in position, without further need for holding or manipulation by the locksmith. Next, by use of a thin drill bit, an axial bore is drilled through a lower portion of the keyway and lock plug, in a manner which is non-destructive to the keyway, plug, tumblers, pins, springs, etc. After the bore is drilled, the drill bit and pin raiser tool are removed from the lock.

The second tool is a turner or torque tool for directly rotating the bolt cam operator. This cam turner tool has a handle and a long, thin shaft, terminating in a slightly curved and flattened blade. This turning tool is inserted through the drilled bore, until it directly engages the cam operator. During its insertion along the bore, it sequentially lifts and holds upward the pins, but does not thereby axially and/or rotationally place the tumblers, pins, or any side bar into a lock opening orientation. Nevertheless, the bolt cam is capable of a direct torquing rotation, for retracting the bolt to the open position, since not even high security locks have means to inhibit this circumstance and action. Thus, a simple partial rotation of the turning tool torques upon the cam operator and rotates it to shift the bolt to the open lock position; in the absence of any rotation of the plug and its projecting tail piece, which would have been required if the proper key had been employed. Thereupon, the cam operator tool is withdrawn from the keyway and the picking has been completed.

If the lock employed twisting tumblers and/or a sidebar, it does not matter, since they do not inhibit the direct turning of the cam operator. The drilling along the interior of the keyway, within the plug, cannot be thwarted by high security mechanisms, because the keyway has to be an open path for the key. There has not been a decoding of the tumblers, nor does the pin raiser act as the normal key, it merely safely opens the keyway for the insertion and drilling by the drill bit.

Differences between security locks by the same as well as different manufacturers can result in the pin raiser wire to need a variable used length, or for the locksmith to have a relatively few pin raisers, each having a different wire length. Also, the handle of the pin raiser might need a few different configurations to properly butt against the face of the lock and door/wall supporting the lock. Different locks might have different axial lengths and/or different cam operator configurations, which would determine the best length of the shaft of the cam operator turner and the shape of its blade.

A safety shield can be positioned over the tailpiece to block subsequent access to the cam operator through the plug, keyway and drilled bore. If the safety shield is installed prior to picking by the herein described method and apparatus, such picking would be thwarted.

DESCRIPTION OF THE PREFERRED EMBODIMENTS

Figure 1:
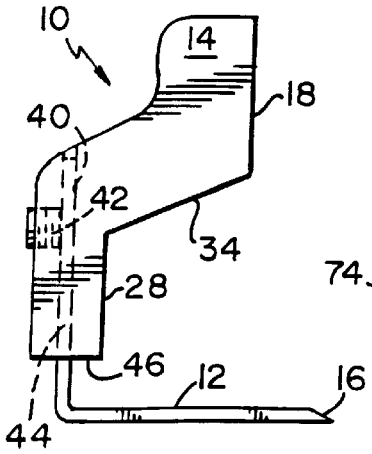
FIG. 1 is a side view of the pin raiser, with portions within its handle in phantom line.

With reference to FIG. 1, the pin raiser tool 10 primarily comprises a pin lifting wire 12 and a handle 14. To ease the entry of the lifting wire into the keyway and in its forward progress, while lifting the spring biased pins, it has ramped tip 16. The term "wire" is employed herein to designate one practical source material—a steel piano wire—rectangularly ground to a height of approximately 1.80 mm. (0.070 inches) and a width of approximately 1.20 mm. (0.050 inches). Such dimensions permit the lifting wire 12 to be inserted through the narrow top section of the keyway and sequentially impinge upon the bottom portions of the pins and lift them above the top plane of the keyway. The material of the pin lifting wire needs to be both strong enough, as well as flexibly resilient, to operate against the downwardly biased pins. The length of the lifting wire depends upon the axial length of the lock plug which houses the pins, tumblers, springs, etc., such that the pins will all have been lifted by full insertion of the lifting wire. Different locks have different axial lengths as well as different exterior casing collar face configurations which need to be considered, as next to be explained.

Figure 3:
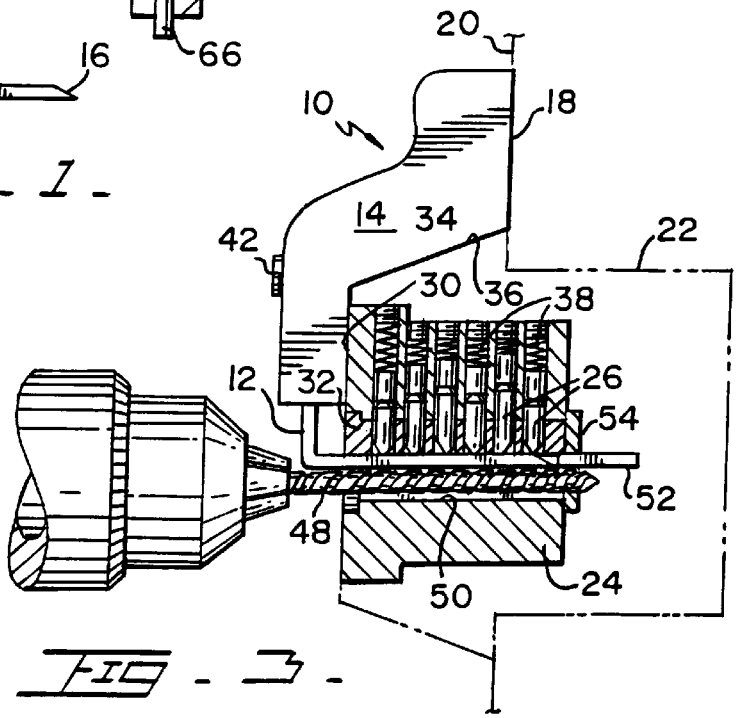
FIG. 3 is a side view, partly in section and partly in elevation, of a lock with the pin raiser and drill bit fully inserted in the plug.

The handle 14 has three important surfaces, each of which have length dimensions and angular relationships to each other dependent upon the shape and size of the face and case collar of the specific lock. With reference to both FIGS. 1 and 3, the upper face 18 of the handle 14 is to lie flush against the door or wall 20 which houses the lock 22, when the lifting wire 12 has been fully inserted into the plug 24, having thereby lifted each of the pins 26. The lower face 28 of the handle 14 is to lie flush against the front face 30 of the lock and above the top of the keyway 32. Generally, the handle faces 18 and 28 would be planar and parallel to each other, because the front face 30 of the lock 22 and the wall or door 20 would be planar and parallel to each other. If that lock face-door/wall relationship were different, the lower and upper faces 28 and 18 would have a correspondingly different angular and offset relationship. The third surface 34 is an intermediate surface of the handle and is joined to the two other handle surfaces, so as to lie flush against the exterior collar or guard 36 of the lock 22, when the lifting wire 12 has been fully inserted into the plug 24. The third surface 34 might have to have one or more curves in it, depending upon the shape of the lock guard 36. Because of the shape of the handle surfaces 18, 28 and 34 and the flexibly resilient material of the pin lifting wire 12, when the pin raiser tool 10 is in its handle-flush to lock and pins lifted by pin lifting wire orientation, the downward bias on the pins 26 by their respective springs 38 will flex the wire 12 sufficiently to cause the handle surfaces 18, 28 and 34 to be held against their associated lock and door/wall surfaces 20, 30 and 36 without any further need for the locksmith to hold or support the pin raiser tool 10 in the desired position, as shown in FIG. 3.

Preferably, the pin lifting wire 12 is adjustably held within a passageway or long slot 40 in the handle 14, as by one or more setscrews 42, which tighten against a portion 44 of the wire 12, which lies interior of the handle 14 and is movable therein for three purposes. One purpose is to adjust the distance the wire 12 lies below the bottom surface 46 of the handle, such that the horizontal plane of the lifting wire 12, when it and the handle 14 are properly oriented in the interior and against the exterior of the lock 22, respectively, is at the top of the keyway 32, to cause the bottoms of the pins 26 to be held as high as practical, away from the drill bit 48, which soon will be inserted in the keyway 32, below the lifting wire 12. The second purpose for adjustably holding the lifting wire 12, as by the setscrew 42, is to be able to control somewhat the effective flexibility of the wire as it passes into the plug 24 and upward against the pins 26. This control aspect can exist if the passageway 40 in the handle 14 is of larger size/diameter/cross-section than the portion 44 of the wire 12 therein. This permits a very small amount of flex movement to the wire, which can reduce the possibility that the wire will break during use. The third purpose of having the lifting wire 12 adjustably held in the handle 14 is to permit its total removal and replacement by a like pin raiser wire, or by a different wire of shorter or longer length, for example, to be used with a lock having a plug 24 of shorter or longer axial length.

The first step of the subject lock picking has above been described. It is the raising of the pins 26 to a level high in the keyway 32 preferably at or about the top plane of the keyway, and holding the pins at that high position in preparation for the second step of the method, drilling an axial bore through a lower portion of the keyway and the plug 24. Although a special and unique pin raiser tool 10 has been disclosed as a preferred tool, it does not form a specific limitation to the method of this invention.

As used herein, relative directional terms, such as "above" and "below" are with reference to the normal orientation of a lock in a door, as shown in the FIGS., with the keyway 32 axially horizontal, the key to be inserted with its smooth edge along the bottom of the keyway and its sawtooth bit edge facing upward, to impinge upon and raise the tumbler pins 26. This is the typical orientation of most high security locks, but not all key operated locks. For example, automobile locks often are wafer type and the keyway receives the key with its bit edge downward.

Figure 4:
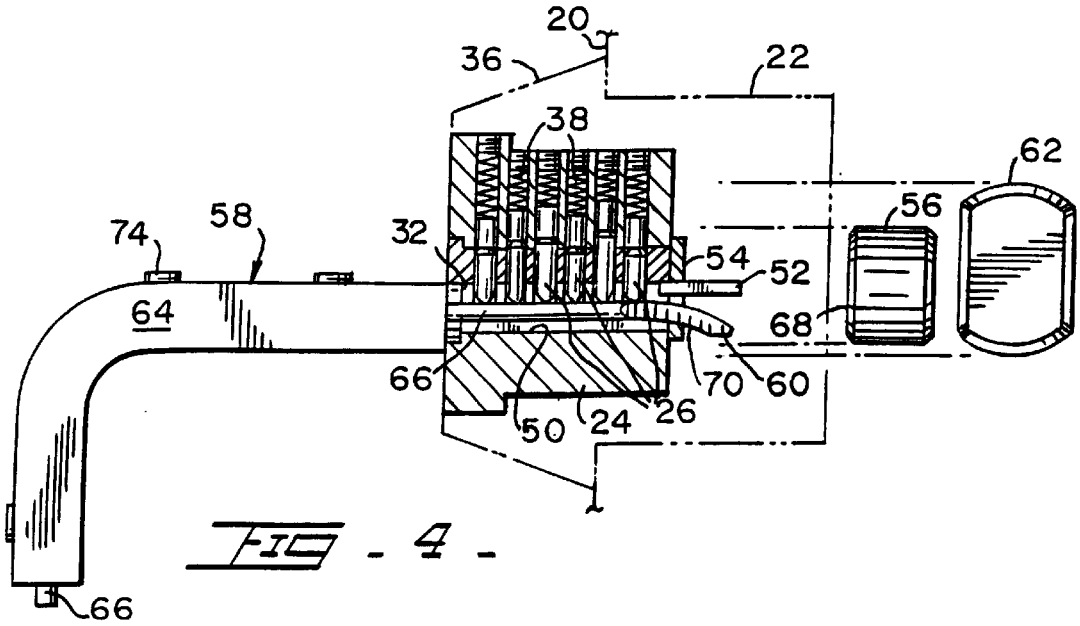
FIG. 4 is similar to FIG. 3, but shows the inserted cam operator turner and, in exploded manner, the cam operator and bolt.
Figure 5:
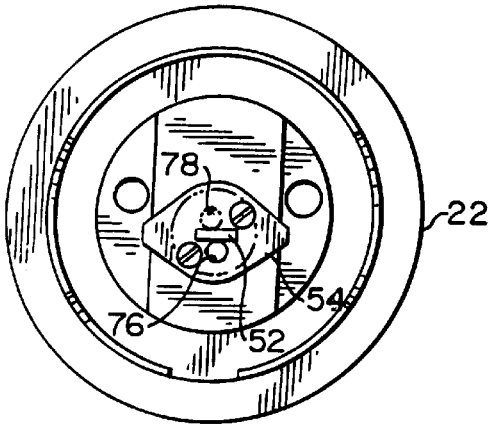
FIG. 5 is the view of the back end of the lock, after drilling through the plug.

The second step of the subject lock picking method is drilling an axial bore 50 through the plug 24, as shown in FIG. 3. Preferably, the bore 50 will pass along the lower part of the keyway 32 and exit the plug 24 just below the tailpiece 52, as also shown in FIG. 5, a rear view of the lock. Such drilling and positioning of the bore 50 is least likely to damage any of the movable components of the lock or inhibit their future movement, i.e. a non-destructive drilling after picking has been completed and the lock returned to normal operation. As shown in FIGS. 3, 4 and 5 a tailpiece retainer or cover plate 54 is removably secured to the rear end of the plug; and this cover is drilled through, so that the bore 50 opens into the cam operator 56, shown on FIGS. 4, 6 and 7. The drill bit 48 should be as thin as possible to achieve a non-destructive drilling of the plug 24. For example, the picking of a high security MEDECO® lock, manufactured by Medeco Security Locks of Salem, Va., can use a 9/64 inch drill bit (approximately 0.14 inches or 3.57 mm). Once the bore 50 has been carefully drilled, the drill bit 48 can be withdrawn from the plug 24 and the pin raiser tool 10 also removed, bringing an end to the second step of the method of this invention.

Figure 2:
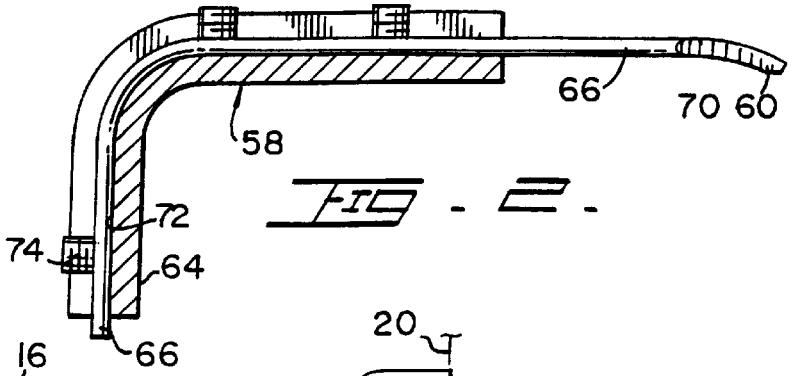
FIG. 2 is a side view of the cam operator turner, partly in elevation and partly in section.
Figure 6:
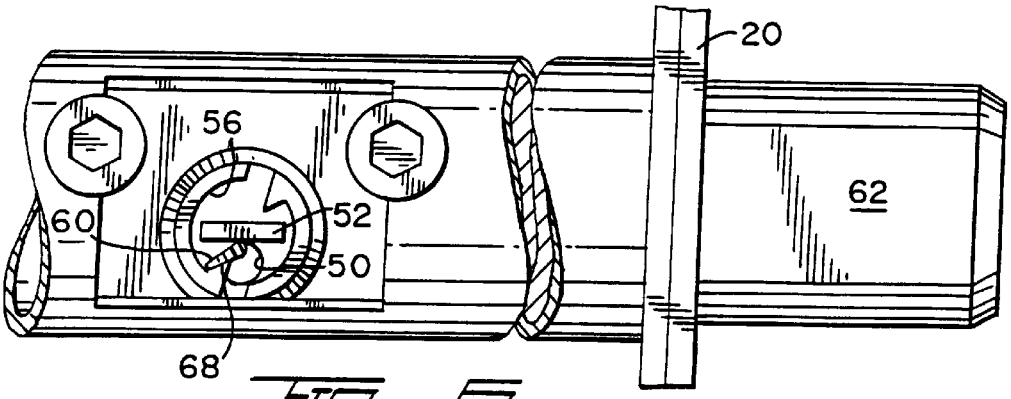
FIGS. 6 and 7 are similar, enlarged, fragmentary side views of the cam operator and bolt in their locked and open orientations, respectively.
Figure 7:
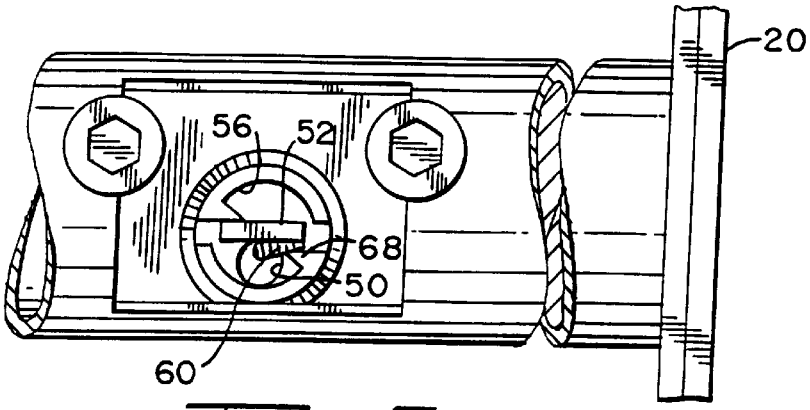

The third step of this innovative method is the direct turning of the cam operator 56, by a tool, such as the unique torque tool 58 shown in FIGS. 2 and 4. The cam turning torque tool 58 is passed through the axial bore 50, until its leading end blade 60 is engaged in the cam operator 56. Turning of torque tool around its axis rotates the cam operator 56 to cause the lock bolt 62 to be withdrawn (slid inward), as shown in FIG. 7; FIG. 6 illustrating the locked or bolt extended orientation. Any tool which can pass through the bore 50 and directly rotate the cam operator 56 to slide the bolt open will meet the needs of this method; however, the unique torque tool 58 is a preferred embodiment. As shown in FIG. 2, the tool 58 has a simple handle 64 and a projecting longitudinal shaft 66, terminating at the blade 60. The blade 60 can be somewhat chisel-shaped, as illustrated, like the end of a screwdriver, to fit up against a working surface 68 of the cam operator 56, as shown in FIGS. 6 and 7. The blade 60 can be curved slightly as at 70, which causes the blade to be positioned radially outward of the axis of the cam, thus requiring less torque force and/or stress on the shaft 66 when the handle 64 is being rotated by the locksmith.

The tool shaft 66 must have a cross section smaller than the diameter of the drill bit 48. Moreover, because of the curve 70, the shaft must be thin and flexible enough, relative to the diameter and length of the bore 50, so that the shaft 66 will not break while being inserted through the plug 24 to the cam operator. The length of the shaft 66 and its mounting in the handle 64 can provide for suitable flexibility and torque capability. The longer the shaft, especially the length it projects from the handle, the easier it will be to insert through the bore 50. However, if the exposed/projecting length of the shaft 66 is the same as, or not much longer than the length necessary to seat the blade 60 axially midpoint in the cam operator 56, then the locksmith will not have to feel and guesstimate how far to push the handle 64 and projecting shaft 66 into the plug 24. If, as shown on FIG. 2, the shaft 66 lies a significant length within the handle 64, and the handle is provided with a passageway or long slot 72 into which the shaft fits, and that passageway is of a larger cross section than the shaft 66, then there can be provided increased useful flexibility and torque tolerance to the working length of the shaft 66 and its blade 60. A useful starting material for the shaft of the torque tool 58 can be a steel piano wire, having a diameter of 0.0925 inches (approximately 2.35 mm.). One or more setscrews 74 can hold the torque wire shaft in the torque tool handle, enabling benefit from the flexibility and torque tolerance length, as well as to facilitate increasing the projecting length of the shaft to accommodate to different locks, and also to permit replacement of another shaft of the same or different specifications.

Once the torque tool 58 has been inserted through the plug 24, as shown in FIG. 4, and into the cam operator 56, as shown in FIGS. 6 and 7, and the handle 64 rotated to rotate the tool blade 60 and cam operator from the FIG. 6 to the FIG. 7 position, the bolt 62 will be shifted to the open—lock has been picked—condition. Thereupon, the torque tool 56 is turned in the opposite direction from the cam torquing direction, for the same lock mechanics reasons that a key is returned to a "home" position before it is removed from the keyway, and the tool shaft 66 is removed from the lock 22.

The just described three step method of: pin lifting, plug boring, and direct turning of the cam operator with a tool introduced through the bore in the plug, preferably but not essentially using the illustrated and disclosed pin raiser tool 10 and cam torquing tool 58, could be the end of the method, but usually it would be prudent to ensure the workability of the lock by partial disassembly and smoothing off and/or clearing out of any metal burrs, dross, etc. from the plug 24, caused by the drilling and picking. If an inspection of the plug caused the locksmith to believe it should be replaced, that labor and plug part replacement would be minor, relative to replacement of the entire lock, had it not been picked according to the present invention.

Once the lock has been drilled and picked as above disclosed, it could be picked subsequently by use of only a suitable cam operator torquing tool. Typically, this would not be desired, since an illegal picking could be done quickly and quietly. Accordingly, after the plug 24 has been demounted, deburred and cleaned, such step requiring removal of the tail piece retaining cover plate 54, that plate, which is symmetric, can be rotated one-half turn and remounted to place the bored hole 76 therein at a position above the tail piece 52, as shown by the dashed circle 78 in FIG. 5, thereby closing that end of the bore 50, to block easy, probably illegal, picking.

If there is no duplicate key soon available, after the picking, or the original key cannot be located, the locksmith, demounted plug in hand, can create a replacement key, or recode the tumblers to require a newly bitted key, which the locksmith then provides.

Figure 8:
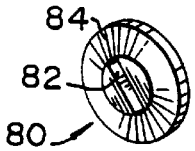
FIG. 8 is a perspective view of the safety shield.
Figure 9:
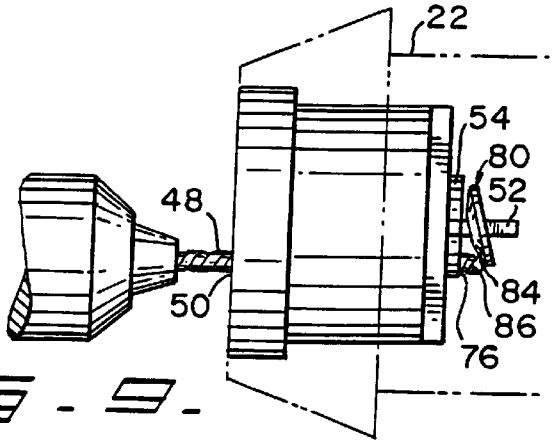
FIG. 9 is a side view of the safety shield installed on a lock tailpiece and deflecting a drill bit.

To inhibit a subsequent picking of a lock which had been picked by the method of this invention, even assuming that the tailpiece retainer plate 54 had been inverted to close the end of the bore 50, a safety shield 80, as shown in FIG. 8, can be placed over the tailpiece 52, as shown in FIG. 9. If the safety shield 80 were to be installed prior to using the picking of this invention, such picking would fail. The safety shield is disk shaped, has a slot 82 and preferably has a beveled surface 84. The dimensions of the slot 82 are to be larger than the cross section of the tailpiece 52, so that there results a loose, wobbly, or floating fit when mounted on the tailpiece. The diameter of the safety shield 80 must be large enough so that it covers the end 76 of the bore 50, but small enough so that the tip 86 of the drill bit 48 will hit the shield and impinge against the beveled surface 84, if the surface 84 is provided. Also, the diameter of the safety disk should approximate the diameter of the cam operator 56, so that, if the drill bit tip 86 were to force the safety disk 80 along the tailpiece 52, the safety disk would then lay against the face of the cam operator 56 and block access to its working surface 68. The thickness of the safety disk is important, it should reduce the open space distance between the end of the bore 50, at the hole 76 in the retainer 54, and the face of the cam operator 56, with its working surface 68. Thus, even if the drill bit 48 were to drill through the disk 80, the shaft 66 of the torquing tool 58 and its curved blade 60 could not flex sufficiently, upon exiting the hole 76 in the tailpiece retainer 54, to then pass through the safety shield 80 and impinge onto off axis working surface 68. The safety disk 80 should be of a very hard material, such as hardened steel, to resist most drill bits.

In use, the safety shield 80 would prevent picking in one or more of the following ways: A drill bit 48, upon exiting the hole 76 in the tailpiece cover 54, would hit the very hard disk, preferably with its beveled surface 84, and not penetrate the disk, and probably be deflected sufficiently, because of the wobble fit and/or the beveled surface, to bind up and to break off within the bore 50. The tip 86 of the drill bit would push the safety shield 80 along the tailpiece to abut the face of the cam operator and, even if the shield then were drilled through, that hole would be radially displaced from the working surface 68 of the cam operator 56 to such an amount that a torquing tool could not pass through the axially aligned bore 50, the hole 76 and the hole in the shield and then reach into the off axis working surface 68. To force a torquing tool to follow that new path to the working surface probably would break the tool shaft 66 inside the lock 22.

While there has been illustrated and described preferred embodiments of this invention's apparatus and method, and there has been mentioned modifications thereto; other changes and modifications may be made within the scope of the appended claims, without departing from the spirit and scope of this invention.

What I claim is:

1. A method for picking a lock having a plug with a keyway and pins which are biased into said keyway, said method comprising the steps of:

(a) raising said pins above a specific level in said keyway;

(b) drilling an axial bore through said plug with a drill bit that enters into said keyway below said specific level, said bore opening to a cam operator, the turning of which can shift the bolt of said lock from closed to open position;

(c) passing a tool through said bore and into direct surface contact with said cam operator; and (d) turning said tool, thereby turning said cam operator.

2. The method according to claim 1, in which, said lock has a tailpiece projecting rearward from said plug toward said cam operator and said specific level above which the pins are raised is that of said tailpiece:

(a) said drilling of said axial bore thereby is below the level of said tailpiece;

(b) said bore being of sufficiently small diameter; and (c) accomplishing said drilling thereof in a manner which is non-destructive to the operation of said keyway and pins.

3. The method according to claim 2 further comprising the steps of:

(a) providing a safety shield for thwarting said passing of said tool along a path from said bore into cam turning contact with said cam operator;

(b) mounting said safety shield onto said tailpiece in a loose manner and generally perpendicularly to said bore;

(c) intercepting said path by a first surface of said safety shield;

(d) said drilling resulting in impinging said drill bit onto said first surface and, because of said loose mounting;

(e) causing said first surface to become other than perpendicular to said path; and (f) thereby deflecting said drill bit from following said path.

4. The method according to claim 3 in which said safety shield has significant thickness, and further comprising the steps of:

(a) drilling through said thickness of said safety shield to define a deflected passageway opening to said cam operator; and (b) passing said tool through said bore requiring said tool also to follow said path to said deflected passageway, the deflecting of which being too great for passing said tool into cam turning surface contact with said cam operator.

5. The method according to claim 1 in which, after the bolt is shifted to the open position:

(a) removing, deburring and reinstalling said plug.

6. The method according to claim 1 in which, said lock has a symmetric tailpiece retainer:

(a) said drilling causes said bore to pass through said tailpiece retainer; and, after said bolt has been shifted open by said steps of picking;

(b) removing, inverting and remounting said retainer, such that said bore no longer opens to said cam operator.

7. The method according to claim 1 in which:

(a) said raising of said pins is by a pin raiser tool;

(b) retaining said pin raiser tool in position during said step of drilling; and (c) thereupon removing said drill bit and said pin raiser tool from said keyway.

8. The method according to claim 7 in which, said step of raising said pins is accomplished by:

(a) inserting a pin lifting portion of said pin raiser tool into said keyway to operate against said bias on said pins; and (b) holding said pin raiser tool in pin raising position by employing the said pin bias on said pin lifting portion.

9. The method according to claim 8 in which, said pin raiser tool has a handle for said pin lifting portion; and:

(a) transmitting said pin bias from said pin lifting portion to said handle, for causing said handle to be held in place relative to said lock.

10. The method according to claim 1 in which:

(a) said passing of said tool through said bore again raises said pins.

11. The method according to claim 1 in which said turning said cam operator is by:

(a) torquing upon said cam operator, by a blade of said tool, at a point on said cam operator which is displaced from the axis of said bore.

12. A lock with an apparatus for thwarting the picking of said lock, said lock having an axial keyway in a plug, a tailpiece and a cam operator mounted exterior said plug and generally aligned with said keyway; said tailpiece projecting from said plug toward said cam operator; picking of said lock requiring at least one tool to pass through said plug, via said keyway, and to directly contact a working surface of said cam operator, said apparatus comprising:

(a) a safety shield interposed in said lock, between said plug and said cam operator, for preventing said tool from directly contacting said working surface; and (b) said safety shield being loosely mounted on said tailpiece of said lock such that said safety shield has an orientation that deflects said tool away from directly contacting said working surface.

13. A method for preventing the picking of a lock having a keyway, a cam which operates a bolt, and a tailpiece, said method comprising:

(a) passing a cam turning tool through said keyway and into direct contact with said cam;

(b) manipulating said tool to turn said cam to operate said bolt into a lock opened position;

(c) mounting a safety shield loosely onto said tailpiece, on the keyway side of said cam, and thereby;

(d) blocking said step of passing by;

(e) deflecting said passing tool from cam turning contact.

14. The method according to claim 13 further comprising:

(a) non-destructively removing portions of said keyway which inhibit said passing.

15. The method according to claim 14 in which, said lock has a cover lying between said keyway and said cam; and (a) said removing includes removing a portion of said cover, so that there is a clear path through said keyway to said cam.

16. Apparatus for picking a lock having a plug with a keyway having a top plane and a narrow top portion and pins which are biased into said keyway, said apparatus comprising:

(a) a pin raiser tool having a handle and a pin lifting member projecting from said handle;

(b) said pin lifting member having a projecting length and height sufficient to pass axially into said narrow top portion of said keyway and reach and raise all of said pins and lift them at one time above said top plane;

(c) said pin lifting member being flexibly resilient when lifting said pins against their bias;

(d) said handle being constructed to hold said pin lifting member in a manner which benefits the flexibility thereof;

(e) said handle having at least one surface which faces at least one exterior lock surface when said pin lifting member passes axially into said keyway;

(f) said handle and said pin lifting member being constructed and arranged such that, when said pin lifting member has passed axially into said keyway and is lifting all of said pins against their bias, said handle surface lies against said lock surface and is held thereagainst by virtue of said bias, absent manual support; and (g) said handle having a second surface which lies at an angle to said one surface and also faces said lock, so as also to be held thereagainst because of said bias.

17. Apparatus according to claim 16 in which:

(a) said handle includes support means for supporting within said handle a significant length of said pin lifting member;

(b) said pin lifting member has a cross-sectional area; and (c) said support means receives said length of said pin lifting member along a path of greater cross-sectional area than that of said pin lifting member.

18. Apparatus for picking a lock having a plug with a keyway having a top plane and a narrow top portion, pins which are biased into said keyway, a cam operator, and a bolt shiftable to an open lock condition upon rotation of said cam operator, said apparatus comprising:

(a) a pin raiser tool having a handle and a pin lifting member projecting from said handle;

(b) said pin lifting member having a projecting length and height sufficient to pass axially into said narrow top portion of said keyway and reach and raise all of said pins and lift them at one time above said top plane;

(c) said pin lifting member being flexibly resilient when lifting said pins against their bias;

(d) said handle being constructed to hold said pin lifting member in a manner which benefits the flexibility thereof;

(e) a cam operator rotation tool having a shaft with a longitudinal axis;

(f) said shaft having a length and cross section suited to be inserted axially through said keyway and directly impinge upon said cam operator;

(g) said shaft having at one end a blade curved away from said axis; and (h) said blade impinging upon said cam operator out from said axis; whereby rotation of said inserted tool rotates said cam operator.

19. Apparatus according to claim 18 in which:

(a) said shaft is resiliently flexible; and (b) said tool has a handle constructed and arranged to support said shaft to enhance its capability to withstand bias from said pins and rotational torque.

20. Apparatus according to claim 18 in which:

(a) said shaft has a cross section which is too large to pass axially through said keyway, unless said keyway is modified, as by an axial bore through said plug.

21. The combination of a lock and an apparatus for picking said lock, said lock having a plug with an axial keyway, pins biased into said keyway, a bolt shiftable upon rotation of a cam operator, and a tailpiece, said apparatus comprising:

(a) a torquing tool having a shaft for lifting said pins as said shaft is passed through said keyway;

(b) a blade at the end of said shaft, for directly impinging upon said cam operator; whereby turning of said shaft applies rotational torque to said blade to rotate said cam operator;

(c) a safety shield interposed between said keyway and said cam operator for blocking said blade from directly impinging upon said cam operator; and (d) said safety shield being loosely mounted on said tailpiece, generally perpendicular to the axis of said axial keyway; whereby (e) as said blade passes out from said keyway, said blade strikes said safety shield and holds it in an orientation other than perpendicular, to thereby deflect said blade.

22. The combination according to claim 21 in which:

(a) said shaft has a cross section which is too large to be safely passed through said keyway, until said keyway is radially enlarged, as by an axial bore non-destructively drilled through said plug.

* * * * *